US009945385B2

(12) United States Patent
Lin et al.

(10) Patent No.: US 9,945,385 B2
(45) Date of Patent: Apr. 17, 2018

(54) ELECTRIC FAN

(71) Applicants: Ming Yi Lin, Taichung (TW); Ching Pai Ko, Changhua County (TW)

(72) Inventors: Ming Yi Lin, Taichung (TW); Ching Pai Ko, Changhua County (TW)

(73) Assignee: Ming Yi Lin, Taichung (TW)

( * ) Notice: Subject to any disclaimer, the term of this patent is extended or adjusted under 35 U.S.C. 154(b) by 310 days.

(21) Appl. No.: 14/882,579

(22) Filed: Oct. 14, 2015

(65) Prior Publication Data

US 2017/0107991 A1 Apr. 20, 2017

(51) Int. Cl.
*F04D 25/10* (2006.01)
*F04D 29/053* (2006.01)
*F04D 29/054* (2006.01)

(52) U.S. Cl.
CPC ..... *F04D 25/105* (2013.01); *F04D 29/053* (2013.01); *F04D 29/054* (2013.01)

(58) Field of Classification Search
CPC ..... F04D 25/105; F04D 29/053; F04D 29/054
See application file for complete search history.

(56) References Cited

U.S. PATENT DOCUMENTS 5,975,862 A * 11/1999 Arahata ..... B25F 5/006 417/234
6,364,638 B1 * 4/2002 Liu ..... F04D 25/105 416/5
8,662,866 B2 * 3/2014 Huang ..... F04D 25/08 417/363
8,708,673 B1 * 4/2014 McNulty ..... F04D 23/003 417/321

* cited by examiner

*Primary Examiner* — Patrick Hamo
(74) *Attorney, Agent, or Firm* — Rosenberg, Klein & Lee

(57) ABSTRACT

The present invention illustrates an electric fan includes a motor, a rotatable disc and a fan blade. The motor has a driving shaft extended outwardly, the rotatable disc is connected with an end of the motor, and a fan shaft is pivotally connected on the rotatable disc and obliquely disposed relative to the driving shaft. The fan blade is disposed on the fan shaft. A connecting member is disposed between the driving shaft and the fan shaft. The rotatable disc is driven by a driving device to drive the fan shaft to rotate about the driving shaft, so as to expand a blowing range of airflow generated by the fan blade.

7 Claims, 10 Drawing Sheets

ELECTRIC FAN

BACKGROUND

1. Technical Field

The present disclosure relates to an electric fan, more particularly to an electric fan having a rotating shaft which is rotatable in all directions to expand a blowing range of airflow.

2. Description of Related Art

An electric fan is a device including a motor and a rotating shaft driven by the motor to rotate, so that a fan blade disposed on and driven by the rotating shaft is rotated to blow out airflow. Please refer to FIG. 10, a conventional electric fan 9 has a motor 91 and a rotating shaft 92 projected from the motor 91, and a fan blade 93 is disposed on a distal end of the rotating shaft 92. However, the rotating shaft 92 is straightly projected from the motor 91 and drives the fan blade 93 to rotate at a fixed location, so that conventional electric fan 9 just blows the airflow towards a single direction and has a disadvantage of smaller blowing range. Although a fan head of the conventional electric fan can be swung left or right to expand the blowing range, the blowing range of the conventional electric fan is still limited and there is much room for improvement in the conventional electric fan.

SUMMARY

An exemplary embodiment of the present disclosure provides an electric fan which has a fan shaft disposed obliquely relative to a driving shaft of a motor. The driving shaft transfers a driving power to rotate a rotatable disc, and the fan shaft is then driven by the rotatable disc, so that the fan shaft can be rotated relative to the driving shaft of the motor, and the blowing range of airflow generated by a fan blade can be expanded.

According to one exemplary embodiment of the present disclosure, an electric fan includes a motor, a rotatable disc and a fan blade. The motor has a driving shaft extended outwardly, the rotatable disc is pivotally connected with an end of the motor, and a fan shaft is pivotally connected on the rotatable disc and obliquely disposed relative to the driving shaft, and a connecting member is disposed between the driving shaft and the fan shaft to drive the fan shaft. The rotatable disc is driven by a driving device to drive the fan shaft to rotate about the driving shaft. The fan blade is disposed on the fan shaft to be driven by the fan shaft.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
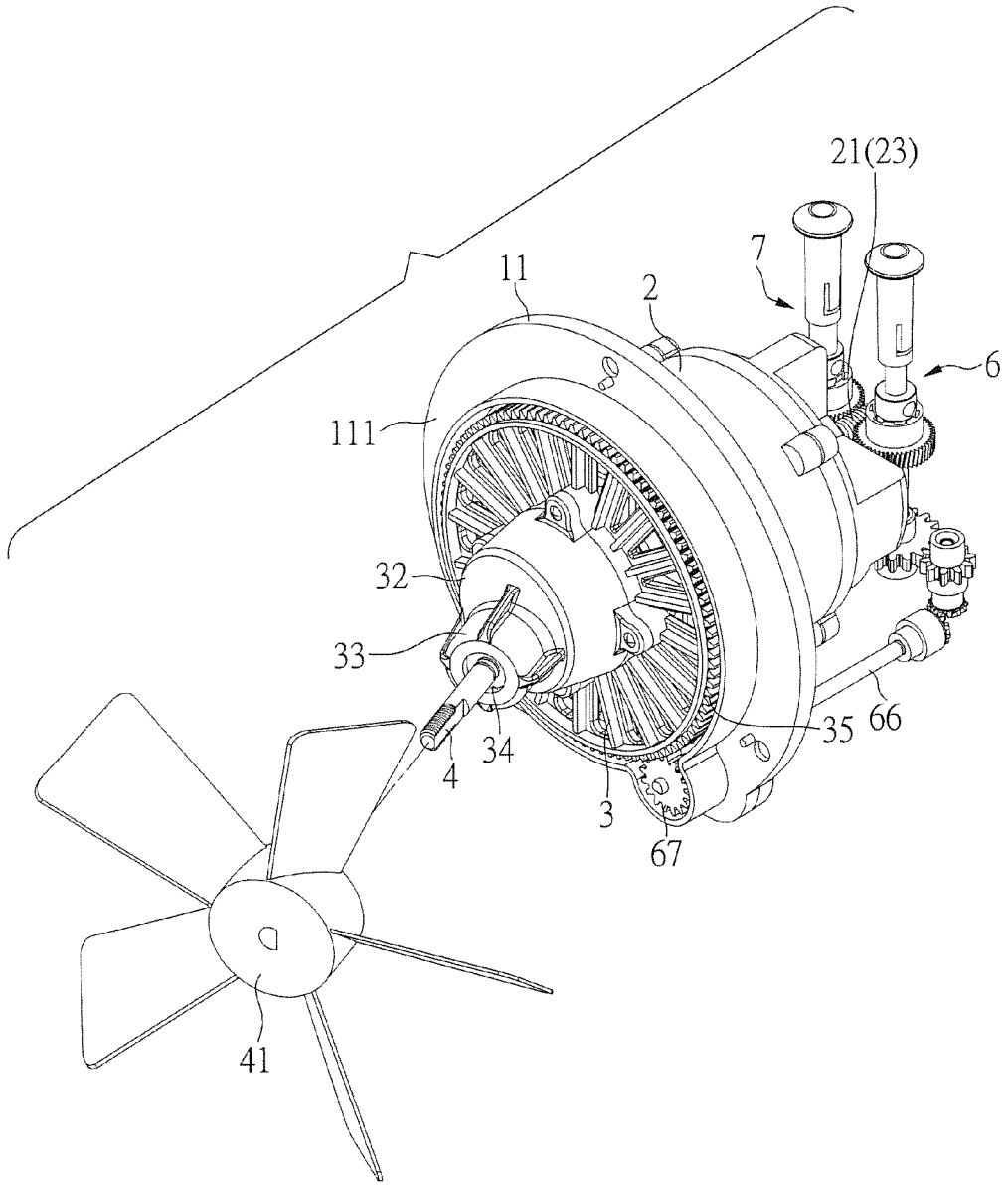
FIG. 1 is a perspective view of a first embodiment of the present invention.

Reference will now be made in detail to the exemplary embodiments of the present disclosure, examples of which are illustrated in the accompanying drawings. Wherever possible, the same reference numbers are used in the drawings and the description to refer to the same or like parts.

Figure 2:
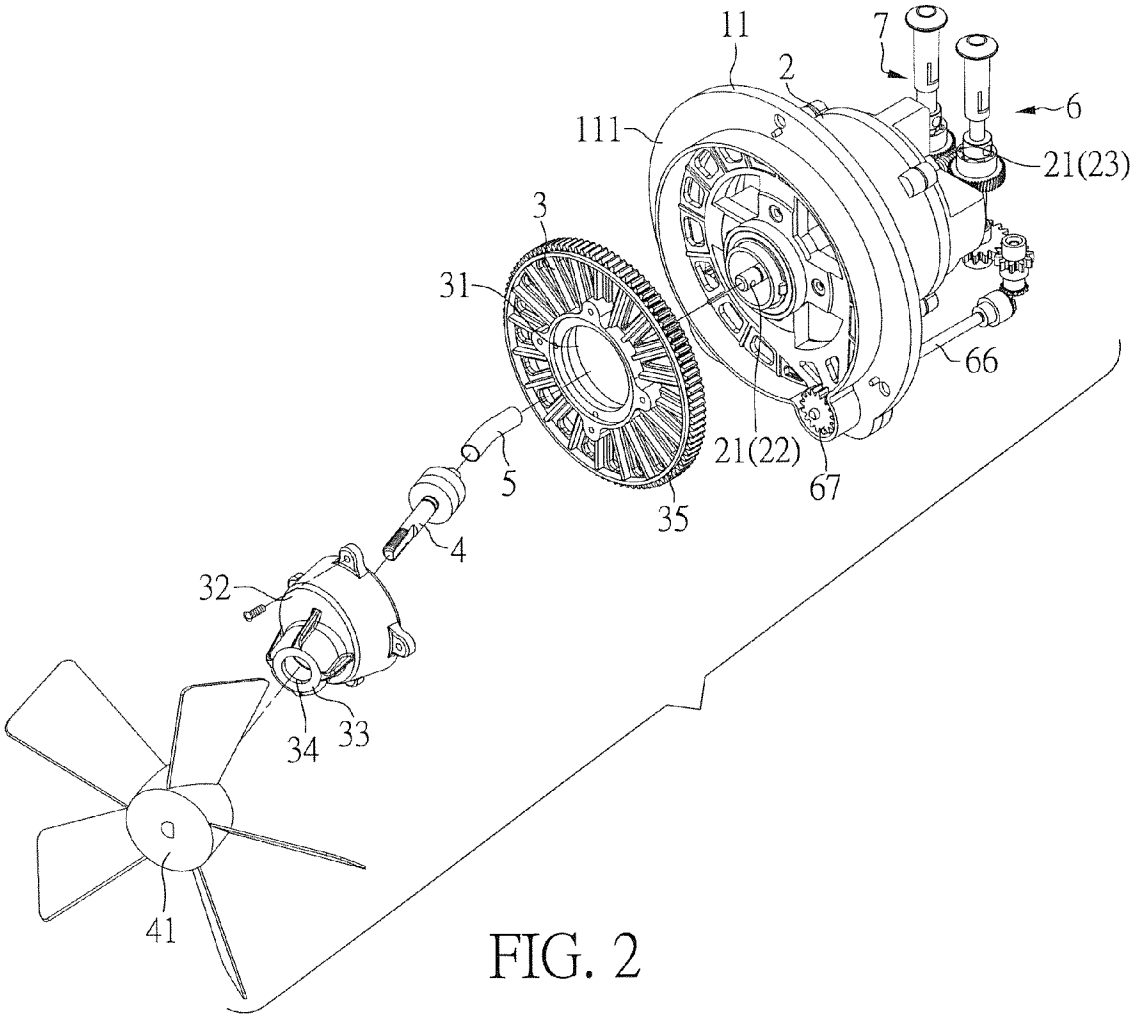
FIG. 2 is an exploded view of the first embodiment of the present invention.
Figure 3:
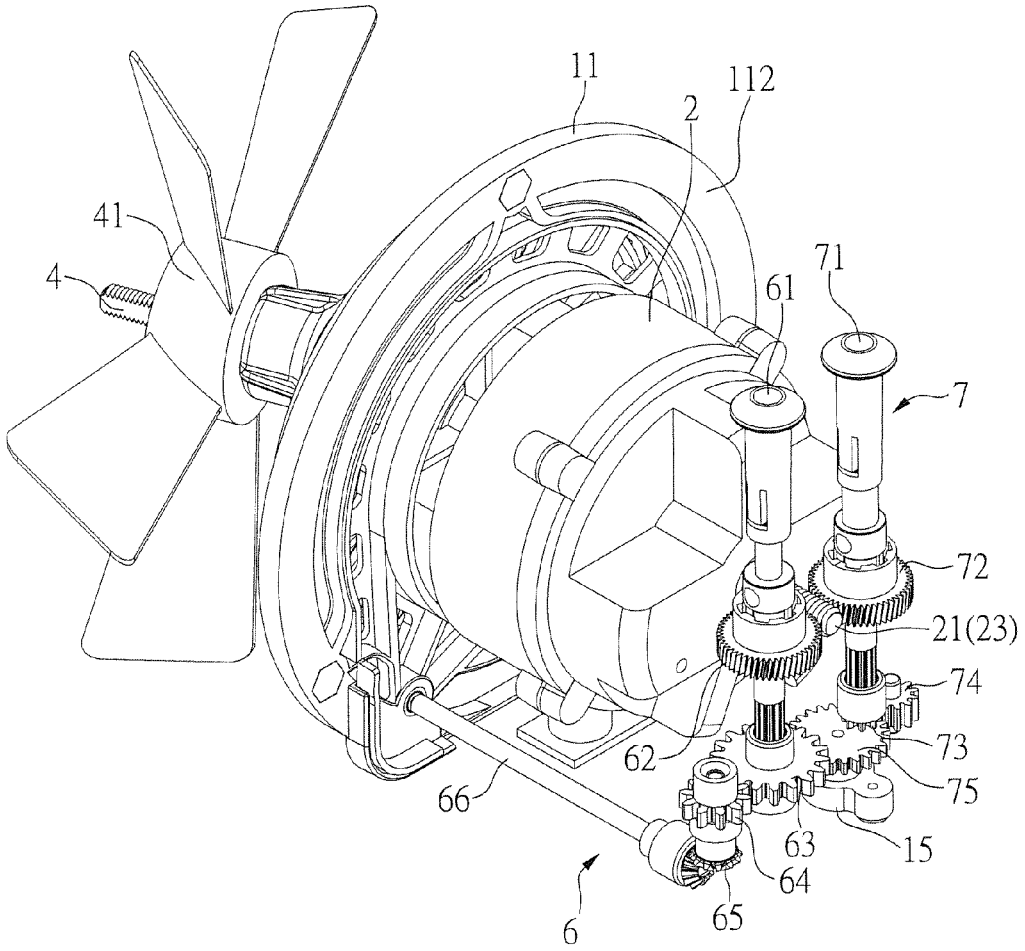
FIG. 3 is a perspective view of the first embodiment of the present invention, when viewed from another angle.

Refer to FIGS. 1 to 3 which show an electric fan of the present invention. The electric fan includes a base member 11 defining a front side 111 and a rear side 112, and a motor 2 disposed on the rear side 112. The motor 2 has a driving shaft 21 extended outwardly, the driving shaft 21 has a first end 22 and a second end 23, the first end 22 is passed through the base member 11 and extended out of the front side 111, and the second end 23 is extended towards a rear part of the base member 1 and has a thread.

The base member 11 has a rotatable disc 3 disposed at the front side 111 thereof, and the rotatable disc 3 is formed with a hole 31 at a center thereof to be inserted through by the first end 22 of the driving shaft 21. The rotatable disc 3 has a restraining part fixed thereon and pivotally connected with a fan shaft 4. The fan shaft 4 is connected with a fan blade 41. In this embodiment, the restraining part is a shell body 32 which is formed with a protrusion part 33. The protrusion part 33 has an opening 34 formed on an top side thereof, and the fan shaft 4 is inserted into and pivotally connected with the protrusion part 33 via the opening 34, and projected from the opening 34. The protrusion part 33 is extended obliquely relative to the first end 22 of the driving shaft 21, to make the opening 34 face an oblique direction relative to the first end 22 of the driving shaft 21, so that the fan shaft 4 is disposed obliquely relative to the first end 22 of the driving shaft 21. A connecting member 5 is connected between the fan shaft 4 and the first end 22 of the driving shaft 21. In this embodiment, the connecting member 5 is a flexible tube having two ends fastened with the fan shaft 4 and the first end 22 of the driving shaft 21, so that the driving shaft 21 drives the fan shaft 4 to rotate synchronously by the connecting member 5, and the fan blade 41 is driven to generate the airflow. While the driving shaft 21 drives the fan shaft 4 to rotate synchronously, the rotation of fan shaft 4 can be driven by the driving shaft 21 to drive the fan blade 41 to rotate since the fan shaft 4 is limited by the opening 34 of the shell body 32 and the connecting member 5 has flexibility.

Figure 4:
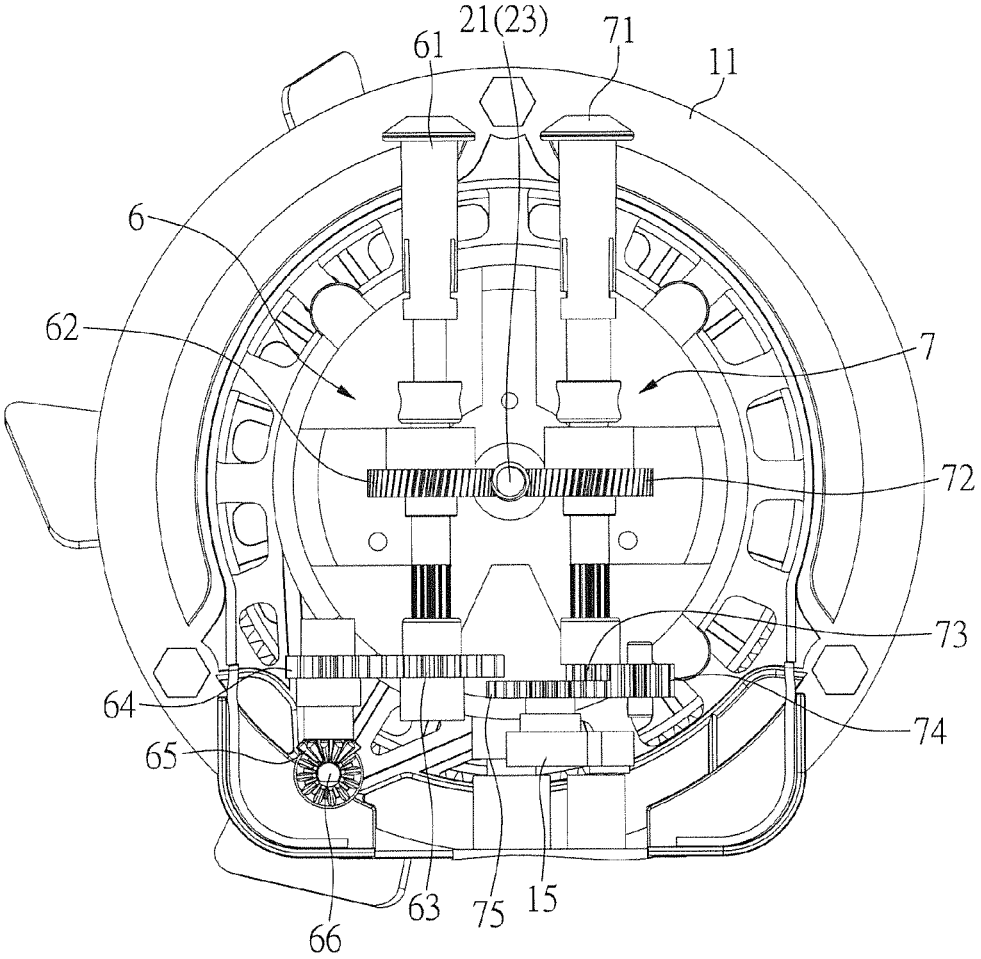
FIG. 4 is a plan view of a rear side of the first embodiment of the present invention.

The rotatable disc 3 is driven by a driving device to rotate about the driving shaft 21 on the base member 11. As shown in FIGS. 3 and 4, in this embodiment, the driving device includes the second end 23 of the driving shaft 21 of the motor 2 and a first transmission mechanism 6 connected with the second end 23. The first transmission mechanism 6 is disposed on the rear side 112 of the base member 11 and implemented by a gear transmission assembly including a plurality of gears, a first pull rod 61 and a gear shaft 66. The first pull rod 61 is formed with a first linking member 62 and a first gear 63 which is engaged with a second gear 64 disposed with a third gear 65 coaxially. The gear shaft 66 has an end linked with the third gear 65 and other end extended to the front side 111 of the base member 11 and formed with a fourth gear 67. With reference to FIG. 1, the rotatable disc 3 has an outer gear part 35 formed on a peripheral edge thereof and engaged with the fourth gear 67. In this embodiment, the first linking member 62 is also a gear engaged with the second end 23 of the driving shaft 21 to transfer the rotation of the driving shaft 21 to rotate the rotatable disc 3.

Figure 5:
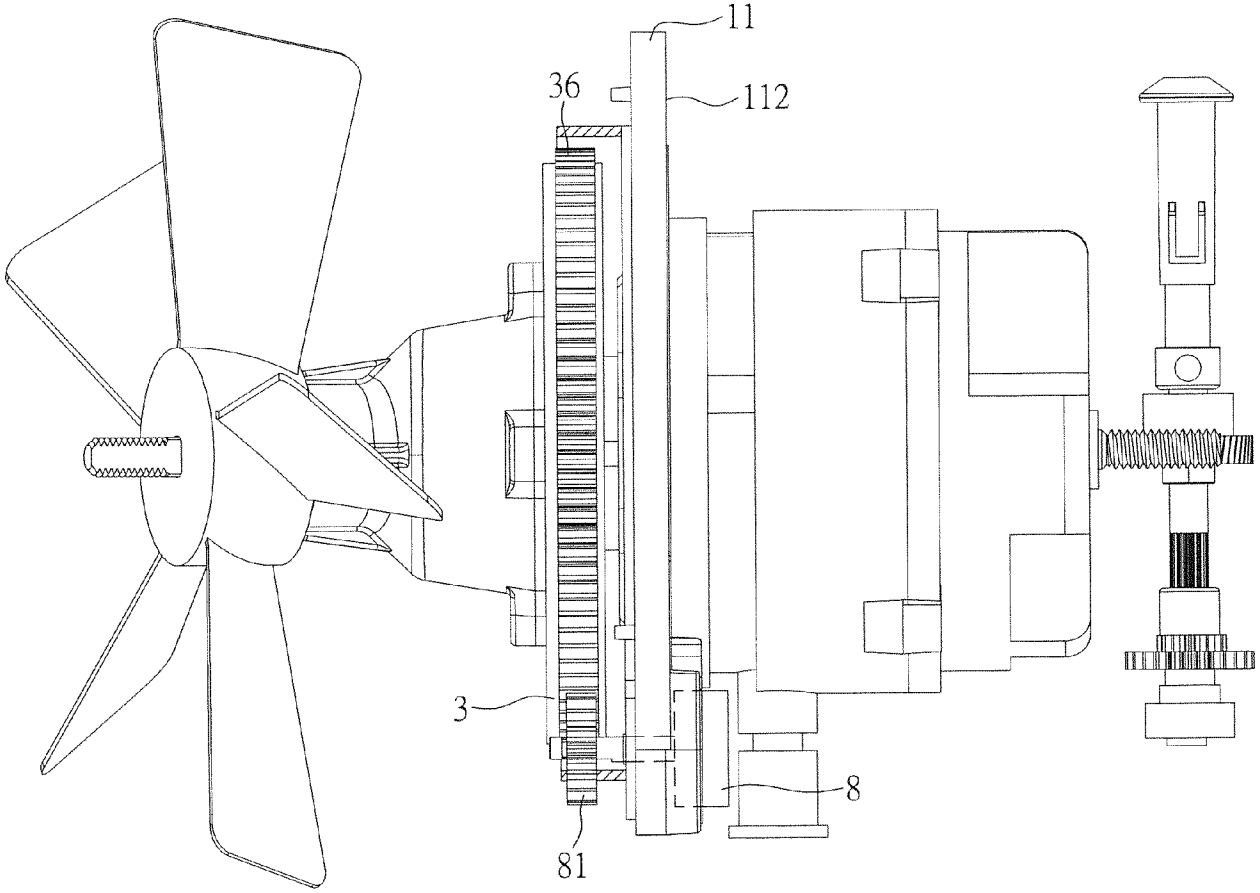
FIG. 5 is a side view of a second embodiment of a driving device of the present invention.

Please refer to FIG. 5 which shows a second embodiment of the driving device of the driving device. In the second embodiment, the driving device includes a servo motor 8 fixed on the rear side 112 of the base member 11 and a driving gear 81 driven by the servo motor 8. The rotatable disc 3 has an outer gear part 36 formed on a peripheral edge thereof and engaged with the driving gear 81, so that the servo motor 8 can drive the rotation of the rotatable disc.

Figure 6:
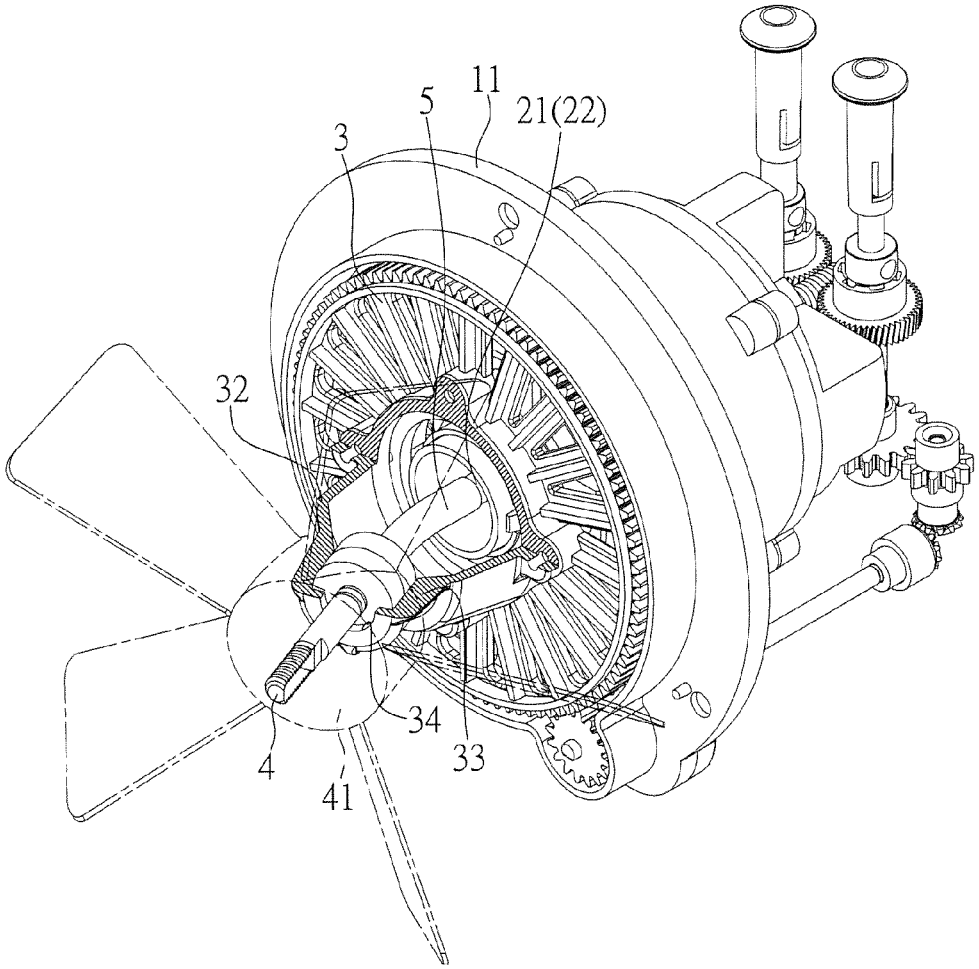
FIGS. 6 and 7 are schematic views of actions of the first embodiment of the present invention.
Figure 7:
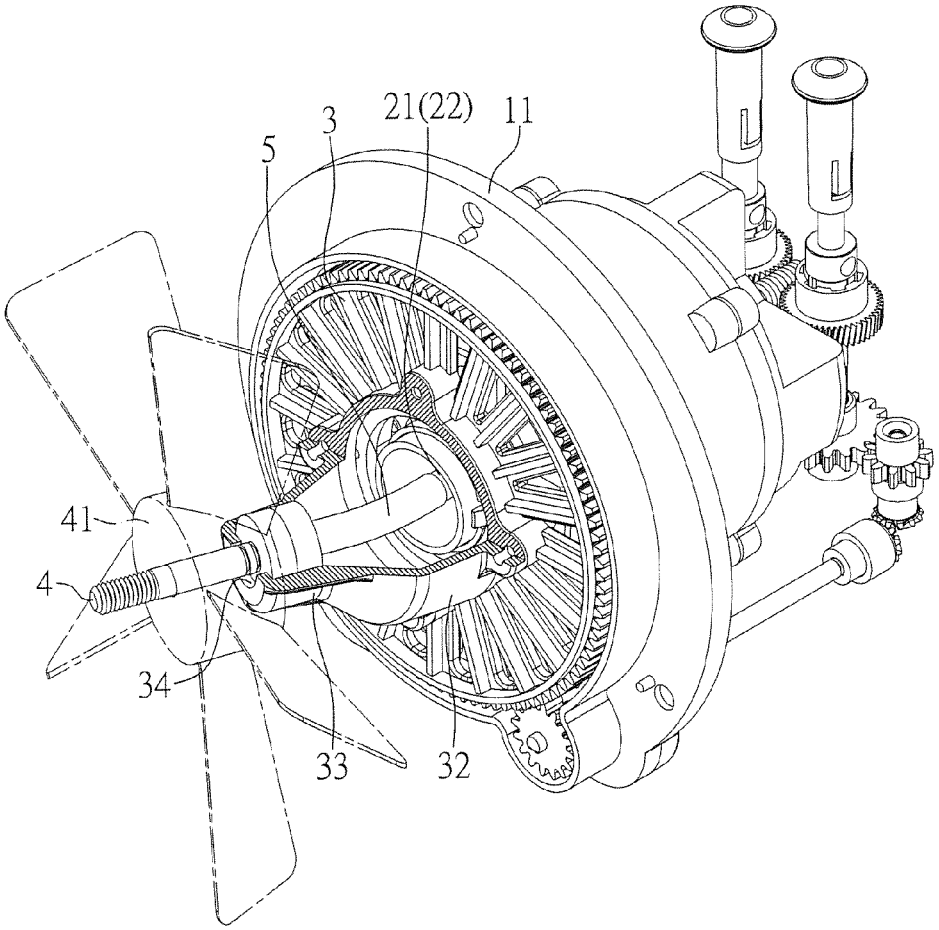

Please refer to FIGS. 6 and 7. While the rotatable disc 3 is rotated, the shell body 32 is driven by the rotatable disc 3 synchronously. Because the fan shaft 4 is constrained by the opening 34 of the protrusion part 33, the fan shaft 4 is driven by the protrusion part 33 to rotate about the first end 22 of the driving shaft 21. By above-mentioned actions, the fan blade 41 is moved with the fan shaft 4 synchronously, so that the blowing direction of the generated airflow is changed along with the rotation of the fan shaft 4 relative to the driving shaft 21, to extend the blowing range.

On the other hand, as shown in FIG. 4, in this embodiment the first pull rod 61 can be pulled to make the first linking member 62 escape from the second end 23 of the driving shaft 21, so that the driving shaft 21 cannot drive the first transmission mechanism 6, and the rotation of the rotatable disc 3 is stopped and the fan shaft 4 is not rotated relative to the driving shaft 21, thereby fixing the blowing direction of the airflow generated by the fan blade 41.

Figure 8:
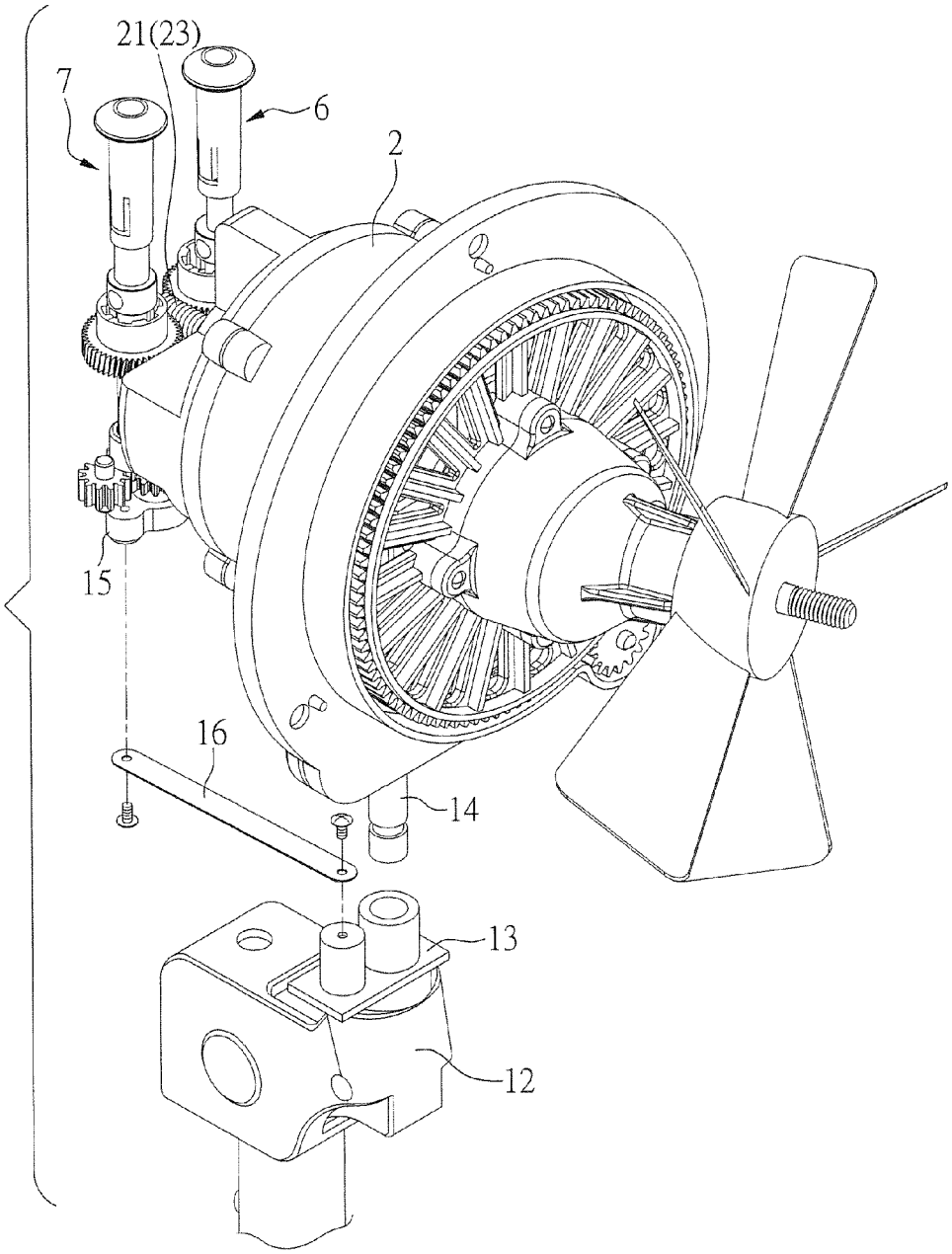
FIG. 8 is an exploded view of a support and the first embodiment of the present invention.

Please refer to FIG. 8. The electric fan of the present disclosure further includes a support 12 which has a shaft seat 13, and the motor 2 is pivotally connected with the shaft seat 13 by a pivot rod 14. The second end 23 of the driving shaft 21 is connected with a second transmission mechanism 7 which is connected with a cam 15, A link rod 16 is linked between the shaft seat 13 and the cam 15. As shown in FIGS. 3 and 4, the second transmission mechanism 7 is a gear transmission assembly including a plurality of gears, a second pull rod 71. The second pull rod 71 is formed with a second linking member 72, which is a gear in this embodiment, engaged with the second end 23 of the driving shaft 21. The second pull rod 71 has a fifth gear 73 formed at a bottom end thereof and connected with a sixth gear 74 and a seventh gear 75 in sequential order. The seventh gear 75 is connected with the cam 15.

By the above-mentioned structure, the cam 15 can be driven by the second end 23 of the driving shaft 21 to rotate via the second transmission mechanism 7, and the motor 2 can be driven by the link rod 16 to swing in a left-and-right back-and-forth manner. On the other hand, in this embodiment the second pull rod 71 can be pulled to make the second linking member 72 escape from the second end 23 of the driving shaft 21, to disable the driving shaft 21 to drive the second transmission mechanism 7, so that the rotation of the cam 15 is stopped and left and right swing action of the motor 2 is also stopped.

Figure 9:
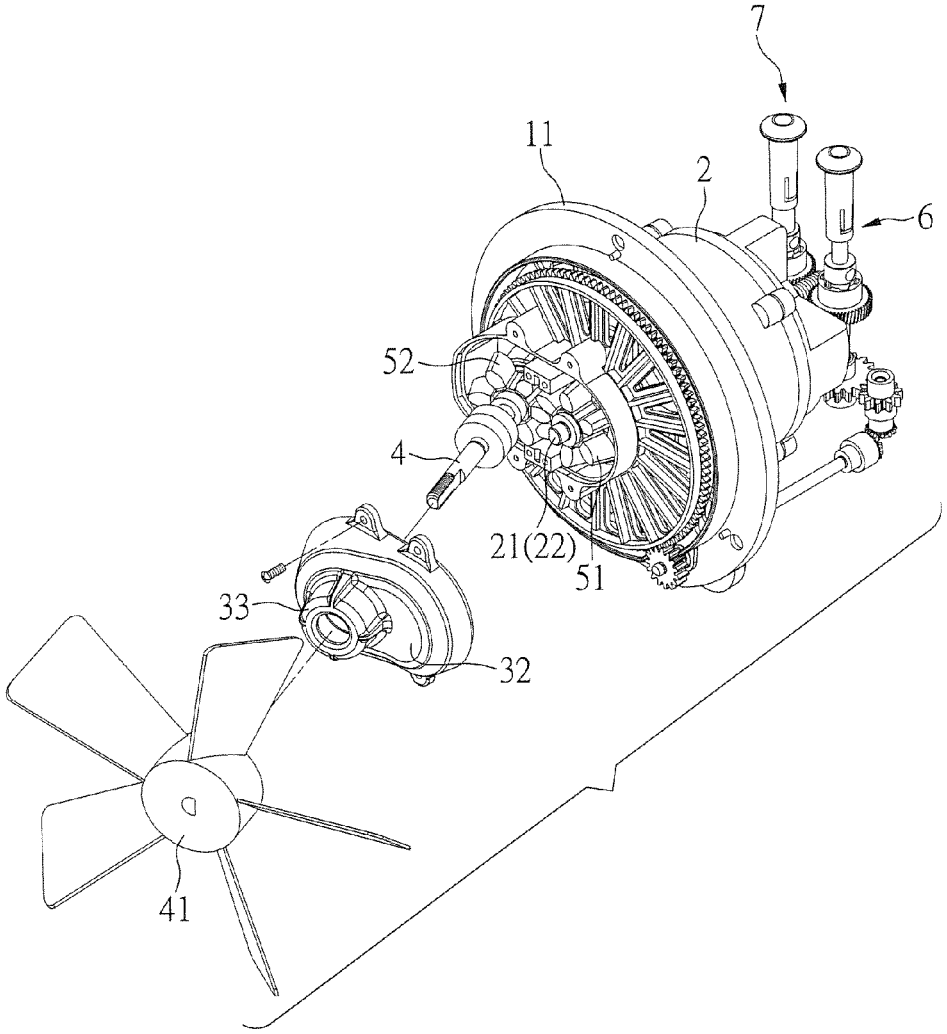
FIG. 9 is an exploded view of a connecting member and the second embodiment of the present invention.
Figure 10:
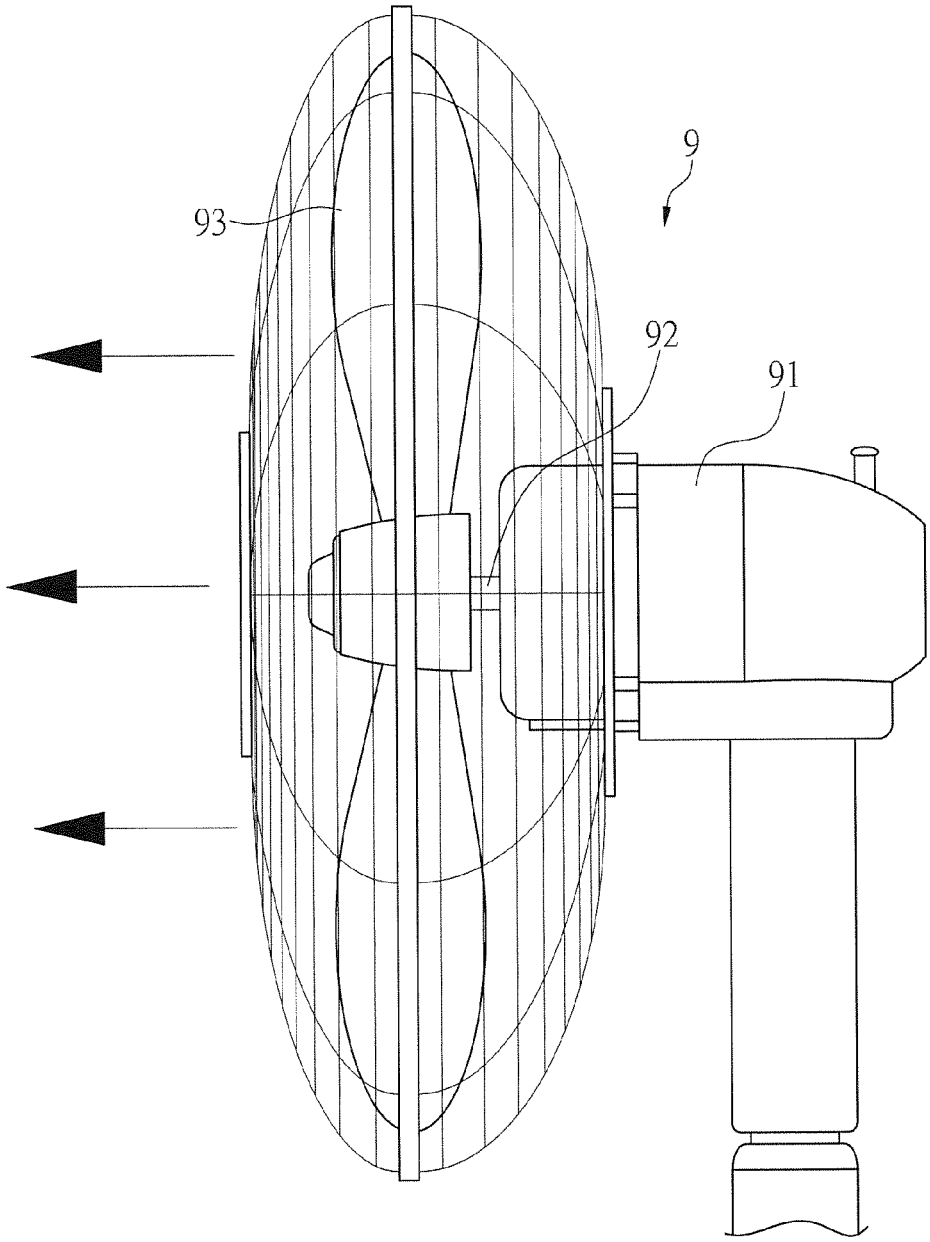
FIG. 10 PRIOR ART
FIG. 10 is a plan view of a structure of a conventional electric fan.

Please refer to FIG. 9 which shows a second embodiment of a connecting member of the present disclosure. In this embodiment, the connecting member includes an eighth gear 51 and a ninth gear 52 engaged with each other. The eighth gear 51 is disposed at the first end 22 of the driving shaft 21 and the ninth gear 52 is disposed at the fan shaft 4. Therefore, the fan shaft 4 can be driven by the first end 22 of the driving shaft 21 to rotate synchronously via the transmission of the eighth gear 51 and the ninth gear 52, thereby achieving the action and effect equal to that of the first embodiment.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An electric fan, comprising:

a motor, having a driving shaft extended outwardly, the driving shaft of the motor having a first end and a second end, an end of the motor being fixed with a base member;

a rotatable disc, pivotally connected with the end of the motor, and a fan shaft pivotally connected rotatably supported on the rotatable disc and by a restraining part to be obliquely disposed relative to the driving shaft, the first end of the driving shaft being extended through the base member and the rotatable disc and a connecting member being connected disposed between the driving shaft and the fan shaft to drive the fan shaft, wherein the rotatable disc being pivotally connected on the base member and driven by a driving device to drive rotate the restraining part and angularly displace the fan shaft to rotate therewith about the driving shaft, the rotatable disk being driven by the second end of the driving shaft of the motor and a first transmission mechanism connected therewith, the rotatable disc having a first gear part formed on a peripheral edge thereof and the second end of the driving shaft being formed with a second gear part, the first transmission mechanism including a plurality of gears engaged with each other, and an end thereof engaged with the first gear part of the rotatable disc and another end of the first transmission mechanism being engaged with the second gear part of the driving shaft, the restraining part receiving the connecting member and the fan shaft being constrained by the restraining part to be rotated obliquely relative to the driving shaft by the rotatable disc; and a fan blade, disposed on the fan shaft to be driven by the fan shaft.

2. The electric fan according to claim 1, wherein the restraining part is a shell body formed with an opening, the connecting member is disposed inside the shell body and the opening faces towards an oblique direction relative to the driving shaft, and the fan shaft is pivotally connected with the opening and extended out of the opening.

3. The electric fan according to claim 2, wherein the connecting member is a flexible tube and has two ends respectively fastened with the fan shaft and the first end of the driving shaft.

4. The electric fan according to claim 2, wherein the connecting member is a transmission gear assembly comprising at least two gears engaged with each other, and having an end connected with the fan shaft and other end connected with the first end of the driving shaft.

5. The electric fan according to claim 1, further comprising a support having a shaft seat to pivotally connect with the motor;

wherein the second end of the driving shaft is further connected with a second transmission mechanism which is connected with a cam, and a link rod is connected between the shaft seat and the cam.

6. The electric fan according to claim 5, wherein each of the first transmission mechanism and the second transmission mechanism has a pull rod, the pull rods are respectively connected with the second end of the driving shaft by linking members, and when one of the pull rods is pulled, and the linking member corresponding to the pulled pull rod escapes from the driving shaft.

7. An electric fan, comprising:

a motor, having a driving shaft extended outwardly, an end of the motor being fixed with a base member;

a rotatable disc, pivotally connected with the end of the motor, and a fan shaft rotatably supported on the rotatable disc by a restraining part to be obliquely disposed relative to the driving shaft, a connecting member being connected between the driving shaft and the fan shaft to drive the fan shaft, the rotatable disc being pivotally connected on the base member and driven by a driving gear coupled to a servo motor, the servo motor being fixed on a side of the base member, the rotatable disc having an outer gear part formed on a peripheral edge thereof and engaged with the driving gear to rotate the restraining part and angularly displace the fan shaft therewith about the driving shaft, the restraining part receiving the connecting member and the fan shaft being constrained by the restraining part to be rotated obliquely relative to the driving shaft by the rotatable disc; and a fan blade, disposed on the fan shaft to be driven by the fan shaft.

* * * * *